US007374665B2

(12) United States Patent
Eppig et al.

(10) Patent No.: US 7,374,665 B2
(45) Date of Patent: May 20, 2008

(54) BLENDING OF RESID FEEDSTOCKS TO PRODUCE A COKE THAT IS EASIER TO REMOVE FROM A COKER DRUM

(75) Inventors: Christopher P. Eppig, Vienna, VA (US); Michael Siskin, Randolph, NJ (US); Fritz A. Bernatz, Houston, TX (US); Charles J. Mart, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 369 days.

(21) Appl. No.: 11/127,735

(22) Filed: May 12, 2005

(65) Prior Publication Data

US 2005/0284798 A1 Dec. 29, 2005

Related U.S. Application Data

(60) Provisional application No. 60/571,348, filed on May 14, 2004.

(51) Int. Cl.
*C10G 9/14* (2006.01)

(52) U.S. Cl. ..... 208/131; 208/14; 208/21; 208/28; 208/40

(58) Field of Classification Search ..... 208/131, 208/14
See application file for complete search history.

(56) References Cited

U.S. PATENT DOCUMENTS

| | | | | |
|---|---|---|---|---|
| 3,558,474 | A | 1/1971 | Gleim et al | 208/108 |
| 3,617,514 | A | 11/1971 | Marlar | 208/131 |
| 3,684,697 | A | 8/1972 | Garnson | 208/131 |
| 3,707,459 | A | 12/1972 | Mason et al. | 208/76 |
| 3,769,200 | A | 10/1973 | Folkins | 208/53 |
| 3,852,047 | A | 12/1974 | Schlinger et al. | 44/24 |
| 4,140,623 | A | 2/1979 | Sooter et al. | 208/131 |
| 4,298,455 | A | 11/1981 | Huang | 208/48 AA |
| 4,399,024 | A | 8/1983 | Fukui et al. | 208/131 |

(Continued)

FOREIGN PATENT DOCUMENTS

| | | |
|---|---|---|
| EP | 0031697 | 7/1981 |

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—Glenn Caldarola
*Assistant Examiner*—John Douglas
(74) *Attorney, Agent, or Firm*—W. Robinson H. Clark

(57) ABSTRACT

A method of blending delayed coker feedstocks to produce a coke that is easier to remove from a coker drum. A first feedstock is selected having less than about 250 wppm dispersed metals content and greater than about 5.24 API gravity. A second delayed coker feedstock is blended with said first resid feedstock so that the total dispersed metals content of the blend will be greater than about 250 wppm and the API gravity will be less than about 5.24.

6 Claims, 3 Drawing Sheets

U.S. PATENT DOCUMENTS

| | | | | |
|---|---|---|---|---|
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,616,308 | A | 10/1986 | Morshedi et al. | 364/159 |
| 4,659,453 | A | 4/1987 | Kukes et al. | 208/108 |
| 4,927,561 | A | 5/1990 | Forester | 252/389.22 |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,460,714 | A | 10/1995 | Fixari et al. | 208/112 |
| 5,645,711 | A | 7/1997 | Hraban et al. | 208/131 |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |

FOREIGN PATENT DOCUMENTS

| | | |
|---|---|---|
| EP | 175511 | 6/1988 |
| GB | 1218117 | 1/1971 |
| WO | 95/14069 | 5/1995 |
| WO | 99/64540 | 12/1999 |
| WO | 03042330 | 5/2003 |
| WO | 03048271 | 6/2003 |
| WO | 2004/038316 | 5/2004 |
| WO | 2004/104139 | 12/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Development Corporation, Paulsboro, NJ. Presented as Paper 19E at the 1990 AIChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accepted Aug. 24, 1998, Elsevier Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AIChE 1998 Spring National Meeting, New Orleans, LA, Mar. 8-12, 1998.

BLENDING OF RESID FEEDSTOCKS TO PRODUCE A COKE THAT IS EASIER TO REMOVE FROM A COKER DRUM

CROSS-REFERENCE TO RELATED APPLICATION

This application claims benefit of U.S. Provisional Patent Application Ser. No. 60/571,348 filed May 14, 2004.

FIELD OF THE INVENTION

The present invention relates to a method of blending delayed coker feedstocks to produce a coke that is easier to remove from a coker drum. A first resid feedstock is selected having less than about 250 wppm dispersed metals content and greater than about 5.24 API gravity. A second delayed coker feedstock is blended with said first resid feedstock so that the total dispersed metals content of the blend will be greater than about 250 wppm and the API gravity will be less than about 5.24.

BACKGROUND OF THE INVENTION

Delayed coking involves thermal decomposition of petroleum residua (resids) to produce gas, liquid streams of various boiling ranges, and coke. Delayed coking of resids from heavy and heavy sour (high sulfur) crude oils is carried out primarily as a means of disposing of these low value resids by converting part of the resids to more valuable liquid and gaseous products, and leaving a solid coke product residue. Although the resulting coke product is generally thought of as a low value by-product, it may have some value, depending on its grade, as a fuel (fuel grade coke), electrodes for aluminum manufacture (anode grade coke), etc.

The feedstock in a delayed coking process is rapidly heated in a fired heater or tubular furnace. The heated feedstock is then passed to a large steel vessel, commonly known as a coking drum that is maintained at conditions under which coking occurs, generally at temperatures above about 400° C. under super-atmospheric pressures. The heated residuum feed in the coker drum results in volatile components that are removed overhead and passed to a fractionator, leaving coke behind. When the coker drum is full of coke, the heated feed is switched to a "sister" drum and hydrocarbon vapors are purged from the drum with steam. The drum is then quenched first by flowing steam and then by filling it with water to lower the temperature to less than about 300° F. (148.89° C.) after which the water is drained. The draining is usually done back through the inlet line. When the cooling and draining steps are complete, the drum is opened and the coke is removed after drilling and/or cutting using high velocity water jets.

Cutting is typically accomplished by boring a hole through the center of the coke bed using water jet nozzles located on a boring tool. Nozzles oriented horizontally on the head of a cutting tool then cut the coke so it can be removed from the drum. The coke cutting and removal steps add considerably to the throughput time of the overall process. Thus, it would be desirable to be able to produce a coke that can be removed from a coker drum with little or no cutting. Such coke would preferably be a substantially free-flowing coke. It would also be desirable to be able to safely remove such substantially free-flowing coke at a controlled flow rate.

Even when the coker drum appears to be completely cooled, some areas of the drum may still be hot. This phenomenon, sometimes referred to as "hot drum", may be the result of a combination of different coke morphologies being present in the drum at the same time. For example, there may be a combination of one or more needle coke, sponge coke or shot coke. Since unagglomerated shot coke may cool faster than other coke morphologies, such as large shot coke masses and sponge coke, it would be desirable to produce predominantly substantially free-flowing unagglomerated shot coke in a delayed coker, in order to avoid or minimize hot drums.

SUMMARY OF THE INVENTION

In accordance with the present invention there is provided a delayed coking process which comprises:

- selecting one or more first delayed coker feedstocks, each having less than about 250 wppm dispersed metals content and greater than about 5.24 API gravity;
- selecting one or more second delayed coker feedstocks and blending said one or more second delayed coker feedstocks into said one or more first delayed coker feedstocks so that the total dispersed metals content of the blended feedstocks will be greater than about 250 wppm and the API gravity will be less than about 5.24;
- heating said blend of feedstocks to a temperature from about 70° C. to about 500° C.;
- conducting said heated blend of feedstocks to a coker furnace wherein the blend of feedstocks is heated to delayed coking temperatures;
- conducting said heated blend of feedstocks to a coker drum wherein vapor products are collected overhead and a solid coke product is produced, which solid coke product is substantially shot coke.

In a preferred embodiment the one or more first and second feedstocks is selected from the group consisting of vacuum resids and deasphalter bottoms.

In another preferred embodiment, coking is performed with a severity index (SI) greater than 20 wherein $SI=(T-880)+1.5\times(50-P)$ where T is the drum inlet temperature in ° F. and P is the drum outlet pressure in psig.

In another preferred embodiment an additive is introduced into the feedstock either prior to heating or after heating and prior to it being introduced in the coker drum, which additive is selected from the group consisting of organic soluble, organic insoluble, or non-organic miscible metals-containing additives that are effective for the formation of substantially free-flowing coke.

In yet another preferred embodiment of the present invention the metal of the additive is selected from the group consisting, potassium, sodium, iron, nickel, vanadium, tin, molybdenum, manganese, aluminum cobalt, calcium, magnesium, and mixtures thereof.

DETAILED DESCRIPTION OF THE PREFERRED EMBODIMENTS

Figure 1:
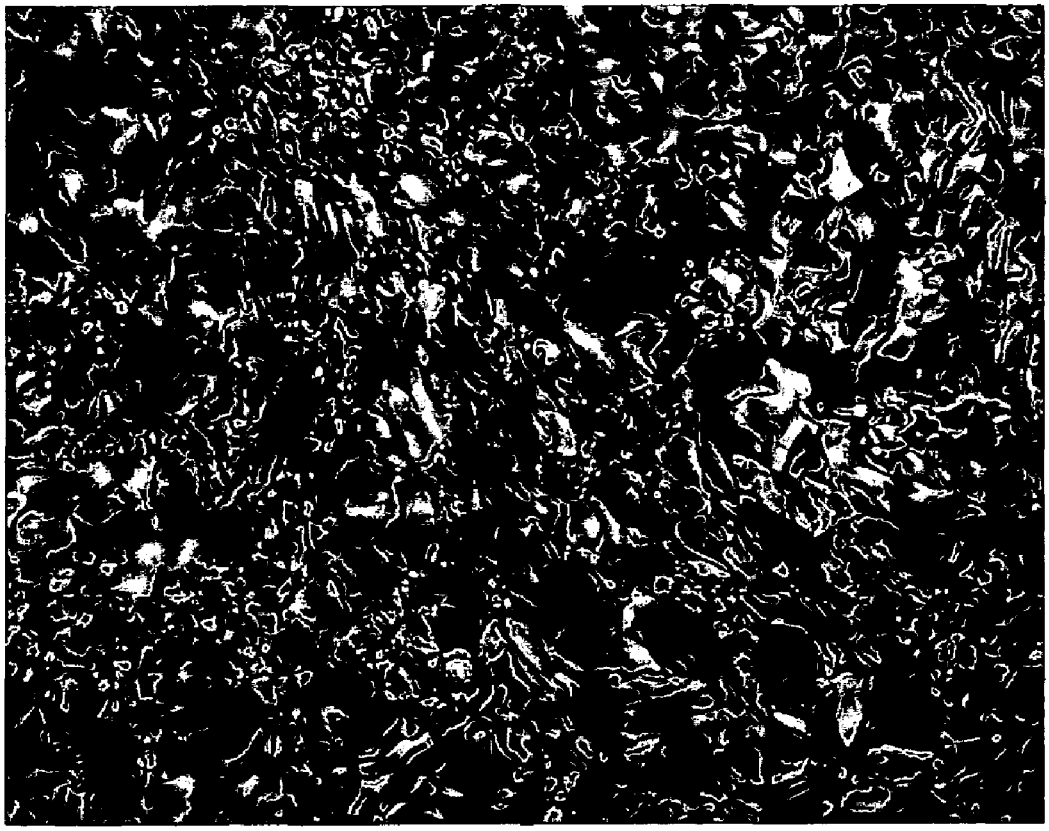
FIG. 1 is an optical micrograph using cross-polarized light showing coke formed from a 100% Chad resid. The micrograph shows flow domains of about 10 to 20 micrometers with a medium/coarse mosaic ranging from about 2 to 10 micrometers. This microstructure is associated with the bulk coke beds having sponge/transition coke morphology.
Figure 2:
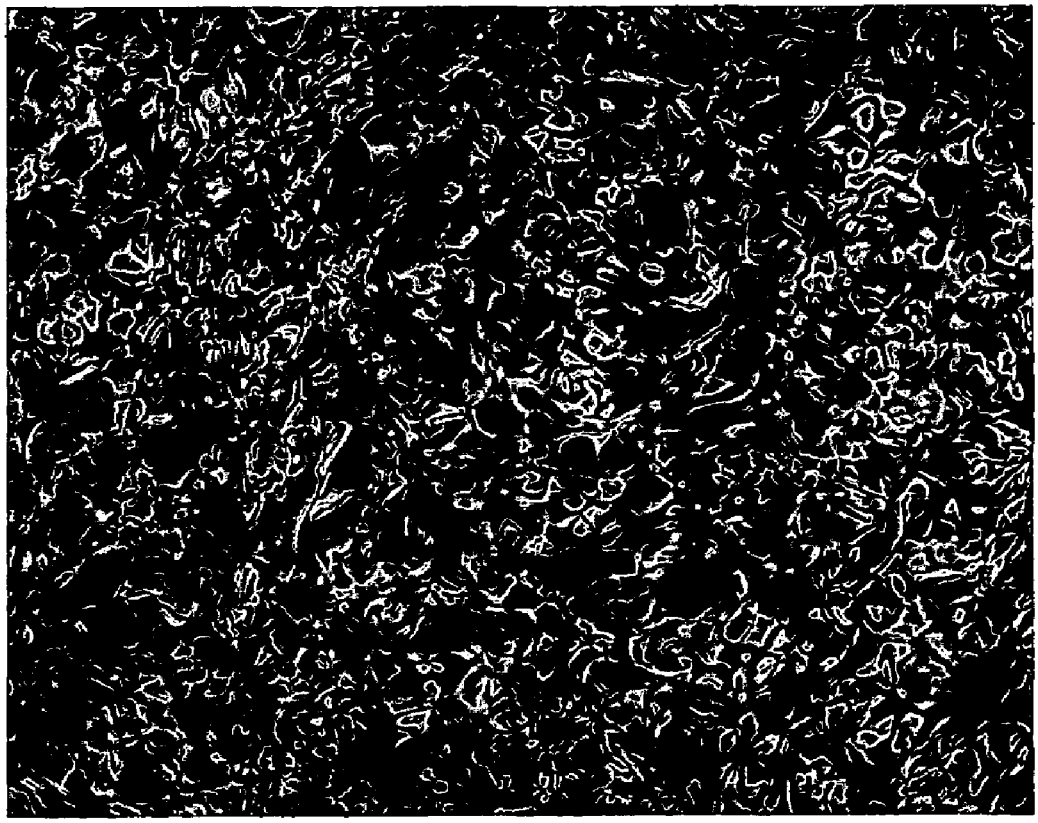
FIG. 2 is an optical micrograph using cross-polarized light showing coke formed from a 100% Maya resid. This micrograph shows a medium/coarse mosaic ranging from about 2 to 10 micrometers. Coke with this microstructure is associated with bulk coke beds having shot coke morphology.
Figure 3:
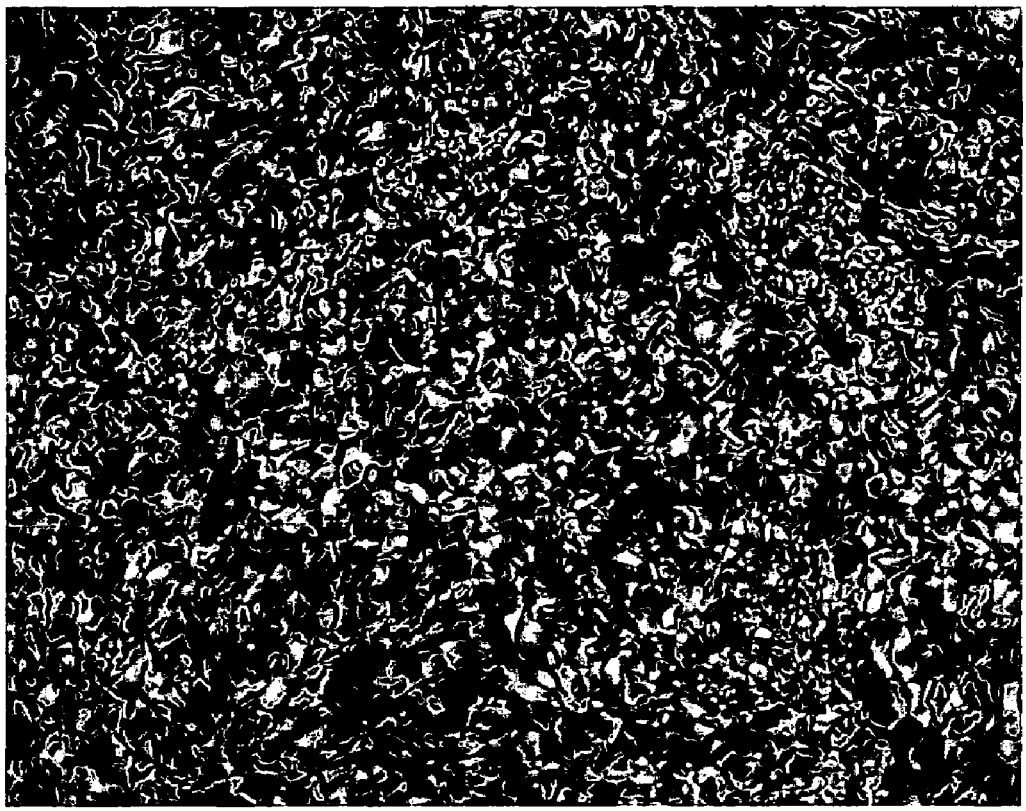
FIG. 3 is the same micrograph of the morphology of coke formed from the blend of 75 wt. % Maya resid and 25 wt. % Chad resid. This micrograph shows that a sponge making resid, like Chad, can be blended with a shot coke making resid like Maya and still form shot coke.

Petroleum residua ("resid") feedstocks are suitable for delayed coking. Such petroleum residua are frequently obtained after removal of distillates from crude feedstocks under vacuum and are characterized as being comprised of components of large molecular size and weight, generally containing: (a) asphaltenes and other high molecular weight aromatic structures that would inhibit the rate of hydrotreating/hydrocracking and cause catalyst deactivation; (b) metal contaminants occurring naturally in the crude or resulting from prior treatment of the crude, which contaminants would tend to deactivate hydrotreating/hydrocracking catalysts and interfere with catalyst regeneration; and (c) a relatively high content of sulfur and nitrogen compounds that give rise to objectionable quantities of $SO_2$, $SO_3$, and $NO_x$ upon combustion of the petroleum residuum. Nitrogen compounds present in the resid also have a tendency to deactivate catalytic cracking catalysts.

Non-limiting examples of resid feedstocks of the present invention include, but are not limited to, residues from the atmospheric and vacuum distillation of petroleum crudes or the atmospheric or vacuum distillation of heavy oils, visbroken resids, bitumen, shale oils, coal liquids, tars from deasphalting units or combinations of these materials. Atmospheric and vacuum topped heavy bitumens can also be included. Typically, such feedstocks are high-boiling hydrocarbonaceous materials having a nominal initial boiling point of about 1000° F. or higher, an API gravity of about 20° or less, and a Conradson Carbon Residue content of about 0 to 40 weight percent.

A blend of feedstocks is chosen in the practice of the present invention that will favor the formation of coke that is easier to remove from a coker drum. The removal of coke from a coker drum is a labor intensive operation and it is desirable to produce a coke that will be easier to remove from the coker drum, thus making the overall coking process more economical.

It is preferred that the two types of feedstocks chosen for blending are compatible. That is, they are chosen to avoid fouling and coking or equipment, other than coking in the coker drum. One preferred way of choosing such a combination of feedstocks is to first determine the insolubility number of each feedstock, followed by determining the solubility blending number for each feedstock, then combining the two types of feedstocks such that the solubility blending number of the blend is always higher than 1.4 times the insolubility number of any feedstock in the blend. Such a technique is taught in U.S. Pat. Nos. 5,871,634 and 5,997,723, both of which are incorporated herein by reference.

Coke bed morphology is typically described in simplified terms such as sponge coke, shot coke, transition coke, and needle coke. Sponge coke, as the name suggests, has a sponge-like appearance with various sized pores and bubbles "frozen into" a solid coke matrix. One key attribute of sponge coke produced by routine coker operating conditions is that the coke is self-supporting, and typically will not fall out of the bottom of an unheaded coker drum, which typically has a head diameter of about 6 feet (1.83 meters).

Shot coke is a distinctive type of coke. It is comprised of individual substantially spherical particles that look like BBs. These individual particles range from substantially spherical to slightly ellipsoidal with average diameters of about 1 mm to about 10 mm. The particles may be aggregated into larger-sized particles, e.g., from tennis-ball size to basketball or larger sizes. The shot coke can sometimes migrate through the coke bed and to the bottom drain lines of the coke drum and slow, or even block, the quench water drain process. While shot coke has a lower economic value that sponge coke, it is the desired product coke for purposes of this invention because its ease of removal from the coker drum results in effectively increasing the process capacity which more than offsets its reduced economic valve.

At times there appears to be a binder material present between the individual shot coke particles, and such a coke is sometimes referred to as "bonded shot" coke. Depending upon the degree of bonding in the bed of shot coke, the bed may not be self-supporting, and can flow out of the drum when the drum is opened. This can be referred to as "fall-out' or "avalanche" and if unexpected it can be dangerous to operating personnel and it can also damage equipment.

The term "transition coke" refers to coke that has morphology between that of sponge coke and shot coke. For example, coke that has a mostly sponge-like physical appearance, but with evidence of small shot spheres that are just beginning to form as discrete particles in one type of transition coke.

Coke beds are not necessarily comprised of all of one type of coke morphology. For example, the bottom of a coke drum can contain large aggregates of shot, transitioning into a section of loose shot coke, and finally have a layer of sponge-rich coke at the top of the bed of coke. There are additional descriptors for coke, although less common. Such additional descriptors include: sandy coke which is a coke that after cutting looks to the naked eye much like coarse black beach sand; and needle coke that refers to a specialty coke that has a unique anisotropic structure. Preparation of coke whose major component is needle coke is well known to those having ordinary skill in the art and is not a subject of this invention.

The term "free-flowing" as used herein means that about 500 tons (508.02 Mg) of coke plus its interstitial water in a coker drum can be drained in less than about 30 minutes through a 60-inch (152.4 cm) diameter opening The feedstock blend of the present invention can be a mixture of bitumens, heavy oils, vacuum resids, atmospheric resids, bitumen, shale oils, coal liquids, deasphalter unit bottoms, a heavy gas oil recycle stream, a distillate recycle stream, a slop oil, and the like. Most preferred is a blend of vacuum resids and vacuum resids with deasphalter bottoms. Further, the blend can be comprised of two or more different residua feedstocks.

Coke beds are not necessarily comprised of all one type of coke morphology. For example, the bottom of a coker drum can contain large aggregates of shot coke, transitioning into a section of loose shot coke, and finally have a layer of sponge-rich coke at the top of the coke bed.

Factors that affect coke bed morphology are complex and inter-related, and include such things as the particular coker feedstock, coker operating conditions, and coke drum hydrodynamics. With this in mind, it has been found by the inventors hereof that the judicious choice of feedstocks and operating severity can push the production of sponge coke to transition coke or from transition coke to shot coke. For example, if a first feedstock is chosen that favors the formation of sponge coke, a second feedstock can be chosen having properties that will, when blended with the first feedstock, result in a transition coke. Also, if the first feedstock favors the formation of a transition coke, the second feedstock can be chosen with the right properties, that when blended with the first feedstock will result in the formation of shot coke, preferably substantially free-flowing shot coke. Proper blending of low percentages of a sponge coke-forming feed into a shot coke-forming feed, or high percentages of a shot coke-forming feed into a sponge coke-forming feed can maintain production of shot coke if the required severity of operating conditions is maintained.

In one embodiment of the present invention a first coker feedstock is selected having less than about 250 wppm dispersed metals content and greater than about 5.24 API gravity. A second feedstock is chosen and blended with the first feedstock so that the total dispersed metals content of the blended feedstock will be greater than about 250 wppm and the API gravity will be less than about 5.24.

An important benefit of this invention is derived when a feedstock does not favor the formation of shot coke, but instead favors the formation of a transition coke. Transition cokes are associated with hot drums, or coke eruptions on cutting the drum. Proper blending to produce shot coke will largely eliminate hot drums. Also, elimination, or the dramatic reduction, of the need to cut the coke out of the drum results in shorter cycle times with an associated increase in capacity/throughput for the process. That is a coke that is formed in a delayed coker that does not need to be cut, or only requires minimal cutting, and that can be empties more rapidly from the drum.

The resid feed is subjected to delayed coking. As previously mentioned, in delayed coking, a residue fraction, such as a petroleum residuum feedstock is pumped to a heater, or coker furnace, at a pressure of about 50 to 550 psig (344.74 to 3792.12 kPa), where it is heated to a temperature from about 900° F. (482.22° C.) to about 950° F. (510° C.). It is preferred that the conditions in the coker furnace not produce coke, thus the temperature and pressure are controlled to just under cracking conditions and the resid is passed through the furnace at short residence times. The heated resid is then discharged into a coking zone, typically a vertically-oriented, insulated coker drum through at least one feed line that is attached to the coker drum near the bottom of the drum.

Pressure in the drum during the on-oil portion of the cycle will typically be about 15 to 80 psig (103.42 to 551,58 kPa). This will allow volatiles to be removed overhead. Conventional operating temperatures of the drum overhead will be between about 415° C. (780° F.) to 455° C. (850° F.), while the drum inlet will be up to about 480° C. (900° F.). The hot feedstock thermally cracks over a period of time (the "coking time") in the coker drum, liberating volatiles composed primarily of hydrocarbon products, that continuously rise through the coke mass and are collected overhead. The volatile products are sent to a coker fractionator for distillation and recovery of various lighter products, including coker gases, gasoline, light gas oil, and heavy gas oil. In one embodiment, a portion of one or more coker fractionator products, e.g., distillate or heavy gas oil may be captured for recycle and combined with the fresh feed (coker feed component), thereby forming the coker heater or coker furnace charge. In addition to the volatile products, delayed coking of the present invention also forms solid substantially free-flowing coke product.

At the completing of the on-oil cycle, steam is typically injected into the coker drum to enhance the stripping of vapor products overhead. During steam stripping, steam is flowed upwardly through the bed of coke in the coker drum and recovered overhead through a vapor exit line. After the vapor products are removed, the drum needs to be cooled before the coke can be removed. Cooling is typically accomplished by flowing quench water upwardly through the bed of coke, thus flooding the coke drum. In conventional delayed coking the quench water is then drained through the inlet line, the drum deheaded, and coke removed by drilling with high pressure water jets.

Conventional coker drums require unheading the coke drum. Since the coke drum must contain a severe atmosphere of elevated temperatures, the bottom cover of a conventional coke drum is typically secured to the coke drum by a plurality of bolts, which often must be loosened manually. As a result, unheading is usually a labor intensive chore. A further drawback of conventional unheading is that it is difficult to use when the coke drum is filled with substantially free-flowing coke, preferably shot coke. Shot coke is unique in that it will not always remain in the drum during and after unheading. This is because the coke is not in the form of a self supporting coke bed, as is sponge coke, but instead is substantially free particles. As a result, the coke will often pour out of the drum as the bottom cover is being removed. In addition, the free-flowing coke may rest on the bottom cover, putting an enormous load on the bottom cover and making its controlled removal difficult.

It is within the scope of this invention that the formation of shot coke, preferably a substantially free-flowing shot coke be encouraged by use of an additive that favors the formation of shot coke. Such an additive can be a metals-containing additive or a metals-free additive. The resid feed is subjected to treatment with one or more additives, at effective temperatures, i.e., at temperatures that will encourage the additives' dispersal in the feed stock. Such temperatures will typically be from about 70° C. to about 500° C., preferably from about 150° C. to about 370° C., more preferably from about 185° C. to about 350° C. The additive suitable for use herein can be liquid or solid form, with liquid form being preferred. Non-limiting examples of metals-containing additives that can be used in the practice of the present invention include metal hydroxides, naphthenates and/or carboxylates, metal acetylacetonates, Lewis acids, a metal sulfide, metal acetate, metal cresylate, metal carbonate, high surface area metal-containing solids, inorganic oxides and salts of oxides, salts that are basic are preferred. Non-limiting examples of substantially metals-free additives that can be used in the practice of the present invention include elemental sulfur, high surface area substantially metals-free solids, such as rice hulls, sugars, cellulose, ground coals, ground auto tires. Other additives include inorganic oxides such as fumed silica and alumina; salts of oxides, such as ammonium silicate and mineral acids such as sulfuric acid and phosphoric acid, and their acid anhydrides.

In another embodiment, the metals-containing additive is a finely ground solid with a high surface area, a natural material of high surface area, or a fine particle/seed producing additive. Such high surface area materials include alumina, catalytic cracker fines, FLEXICOKER cyclone fines, magnesium sulfate, calcium sulfate, diatomaceous earth, clays, magnesium silicate, vanadium-containing fly ash and the like. The additives may be used either alone or in combination.

In another preferred embodiment, a caustic species is added to the resid coker feedstock. When used, the caustic species may be added before, during, or after heating in the coker furnace. Addition of caustic will reduce the Total Acid Number (TAN) of the resid coker feedstock and also convert naphthenic acids to metal naphthenates, e.g., sodium naphthenate.

Uniform dispersal of the additive into the vacuum resid feed is desirable to avoid heterogeneous areas of shot coke formation. Dispersing of the additive is accomplished by any number of ways, for example, by solubilization of the additive into the vacuum resid, or by reducing the viscosity of the vacuum resid prior to mixing in the additive, e.g., by heating, solvent addition, use of organometallic agents, etc. High energy mixing or use of static mixing devices may be employed to assist in dispersal of the additive agent.

The invention claimed is:

1. A method of increasing the capacity of a delayed coking unit using a delayed coker feedstock having less than 250 wppm dispersed metals content and greater than 5.24 API gravity, the method being to shorten the cycle time of the unit by the steps comprising:

selecting one or more first delayed coker feedstocks, each having less than about 250 wppm dispersed metals content and greater than about 5.24 API gravity;

selecting one or more second delayed coker feedstocks and blending said one or more second delayed coker feedstocks into said one or more first delayed coker feedstocks so that the total dispersed metals content of the blended feedstocks will be greater than about 250 wppm and the API gravity will be less than about 5.24;

heating said blend of feedstocks to a temperature from about 70° C. to about 500° C.;

conducting said heated blend of feedstocks to a coker furnace wherein the blend of feedstocks is heated to delayed coking temperatures;

conducting said heated blend of feedstocks to a coker drum wherein vapor products are collected overhead and a free-flowing solid shot coke product is produced, quenching the coke with water and draining the free-flowing shot coke product with interstitial water from the coker drum by unheading the drum and permitting the shot coke product to pour out of the drum.

2. The process of claim 1 wherein the one or more first and second feedstocks are selected from the group consisting of vacuum resids and deasphalter bottoms.

3. The process of claim 1 wherein an additive is incorporated in said blend of feedstocks which additive is an organic soluble, organic insoluble, or non-organic miscible metals-containing additive that is effective for the formation of substantially free-flowing coke.

4. The process of claim 3 wherein the additive is added to either said one or more first delayed coker feedstocks or to said one or more second delayed coker feedstocks.

5. The process of claim 3 wherein the additive is added to the blend of said one or more first delayed coker feedstocks and said one or more second delayed coker feedstocks.

6. The process of claim 3 wherein the metal of the additive is selected from the group consisting of sodium, potassium, iron, nickel, vanadium, tin, molybdenum, manganese, aluminum cobalt, calcium, magnesium, and mixtures thereof.

* * * * *